US009574537B2

(12) United States Patent
Hayman et al.

(10) Patent No.: US 9,574,537 B2
(45) Date of Patent: Feb. 21, 2017

(54) FUEL RAIL FOR AN INTERNAL COMBUSTION ENGINE

(71) Applicant: GM GLOBAL TECHNOLOGY OPERATIONS LLC, Detroit, MI (US)

(72) Inventors: Alan W. Hayman, Romeo, MI (US); Eric C. Douse, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 188 days.

(21) Appl. No.: 14/628,873

(22) Filed: Feb. 23, 2015

(65) Prior Publication Data

US 2016/0245252 A1 Aug. 25, 2016

(51) Int. Cl.

| | |
|---|---|
| ***F02M 55/02*** | (2006.01) |
| ***F02M 61/14*** | (2006.01) |
| ***F02M 63/02*** | (2006.01) |
| ***F02M 35/10*** | (2006.01) |
| ***F02M 43/00*** | (2006.01) |
| ***F02D 19/06*** | (2006.01) |

(52) U.S. Cl.

CPC ..... *F02M 63/0285* (2013.01); *F02D 19/06* (2013.01); *F02M 35/10216* (2013.01); *F02M 43/00* (2013.01); *F02M 55/025* (2013.01); *F02M 2200/857* (2013.01)

(58) Field of Classification Search

CPC ..... F02M 63/0275; F02M 63/0285; F02M 35/10216; F02M 55/025; F02M 2200/875; F02M 43/00; F02M 61/14; F02M 61/145; F02M 69/465; F02D 19/06

USPC ..... 123/456, 468, 469, 470, 195 A

See application file for complete search history.

(56) References Cited

U.S. PATENT DOCUMENTS

| | | | | |
|---|---|---|---|---|
| 6,543,225 | B2 | 4/2003 | Scuderi | |
| 6,990,959 | B1 * | 1/2006 | Zdroik | F02M 69/462 123/184.31 |
| 9,062,640 | B2 * | 6/2015 | Yamamoto | F02M 51/06 |
| 2005/0139196 | A1 * | 6/2005 | Seymour | F02M 55/025 123/456 |
| 2008/0202472 | A1 * | 8/2008 | Whatley | F02M 69/465 123/469 |
| 2010/0275883 | A1 * | 11/2010 | Hohkita | F02M 55/025 123/456 |

* cited by examiner

*Primary Examiner* — Hai Huynh

(74) *Attorney, Agent, or Firm* — Quinn Law Group, PLLC

(57) ABSTRACT

A first fuel rail of an engine connects to first fuel injectors and a second fuel rail connects to second fuel injectors. The first fuel injectors each includes a tip portion projecting through an opening in the cylinder head into the combustion chamber. The second fuel injectors each includes a tip portion projecting through an opening in a bottom portion of an intake port. The first fuel rail includes first mounting brackets each including an aperture, and outwardly projecting mounting bosses, and fixedly attaches to the cylinder head via fasteners that pass through the apertures of the first mounting brackets and attach to the mounting bosses of the cylinder head. The second fuel rail includes second mounting brackets each including an aperture. The second fuel rail fixedly attaches to the first fuel rail via fasteners that attach to the mounting bosses of the first fuel rail.

8 Claims, 3 Drawing Sheets

FUEL RAIL FOR AN INTERNAL COMBUSTION ENGINE

TECHNICAL FIELD

The disclosure relates to fuel rails for internal combustion engine, and attachment thereof.

BACKGROUND

Internal combustion engines may employ fuel injection systems to deliver pressurized fuel into or near combustion chambers to generate mechanical power by combusting fuel/air mixtures. Known fuel injection systems may include port fuel injection (PFI) systems, which include a plurality of fuel injectors fluidly coupled to a common fuel rail for a bank of engine cylinders, wherein one or more of the injectors is configured to inject fuel upstream of an engine intake valve associated with each of the cylinders during engine operation. Known fuel injection systems may include direct-injection (DI) systems, which include a plurality of fuel injectors fluidly coupled to a common fuel rail for a bank of engine cylinders, wherein individual injectors inject fuel directly into individual ones of the combustion chambers during engine operation. Known engine systems may be configured to include both DI and PFI fuel injection systems. Packaging issues arise with dual DI/PFI fuel injection systems.

SUMMARY

An internal combustion engine is described, and includes a cylinder bank of an engine block and an associated cylinder head forming a plurality of variable volume combustion chambers. The cylinder head includes a plurality of intake ports, intake throats, and intake valves associated with the combustion chambers, and a plurality of mounting bosses. A first fuel rail fluidly connects to a plurality of first fuel injectors associated with the cylinders and a second fuel rail fluidly connects to a plurality of second fuel injectors associated with the cylinders. Each of the first fuel injectors includes a fuel-delivering tip portion projecting through an opening in the cylinder head into the corresponding combustion chamber of the associated cylinder. Each of the second fuel injectors includes a fuel-delivering tip portion projecting through an opening in a bottom portion of the intake port of the associated cylinder. The first fuel rail includes a plurality of first mounting brackets each including an aperture and a plurality of outwardly projecting mounting bosses. The first fuel rail fixedly attaches to the cylinder head via a plurality of fasteners that pass through the apertures of the first mounting brackets and attaches to the mounting bosses of the cylinder head. The second fuel rail includes a plurality of second mounting brackets each including an aperture. The second fuel rail fixedly attaches to the first fuel rail via a plurality of fasteners that pass through the apertures of the second mounting brackets and attach to the mounting bosses of the first fuel rail.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

DETAILED DESCRIPTION

Figure 1:
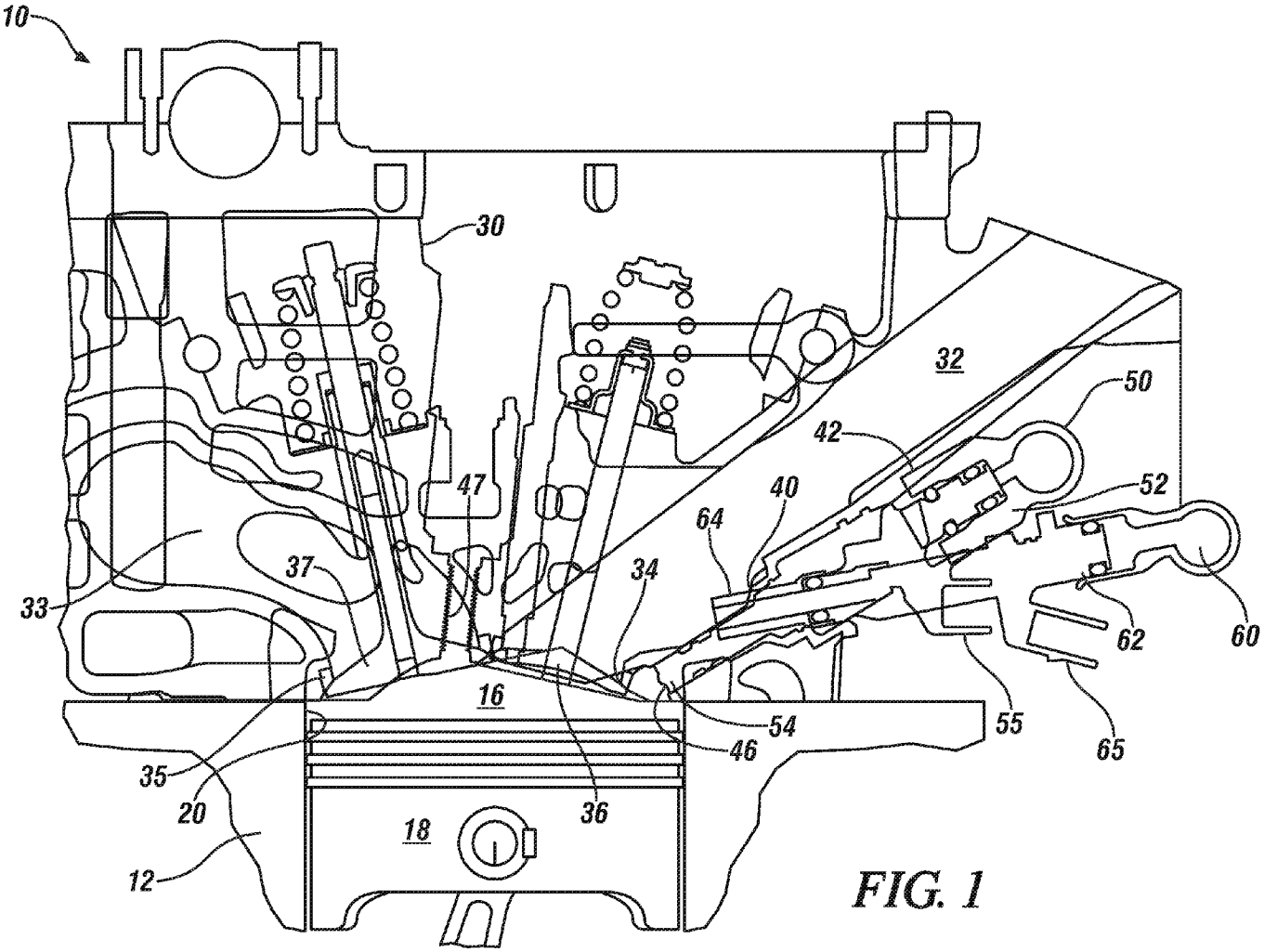
FIG. 1 schematically shows a cutaway end view of a portion of an internal combustion engine including a single cylinder 20 and associated dual fuel rail assembly 45, in accordance with the disclosure.
Figure 2:
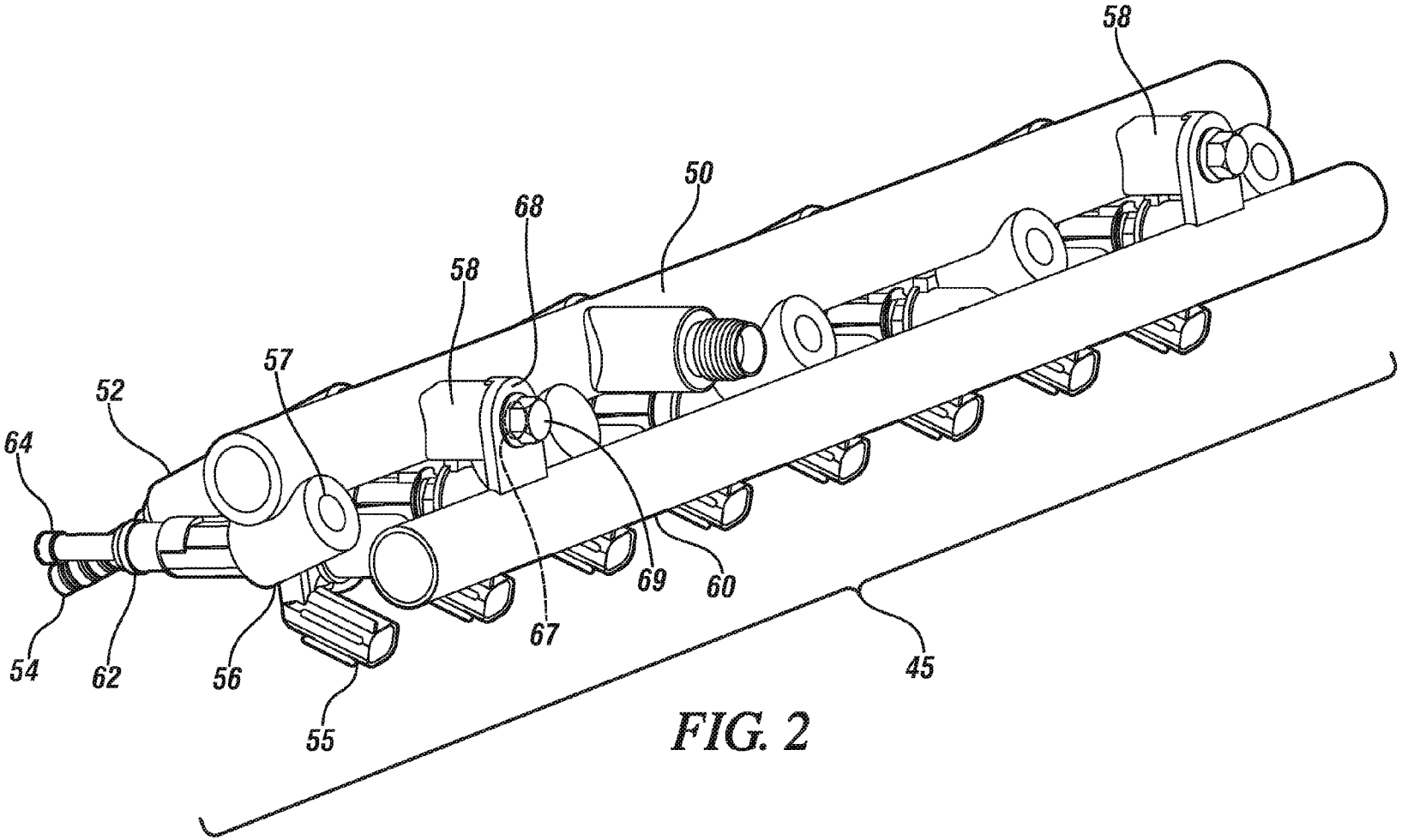
FIG. 2 schematically shows an isometric view of an embodiment of the dual fuel rail assembly, in accordance with the disclosure.
Figure 3:
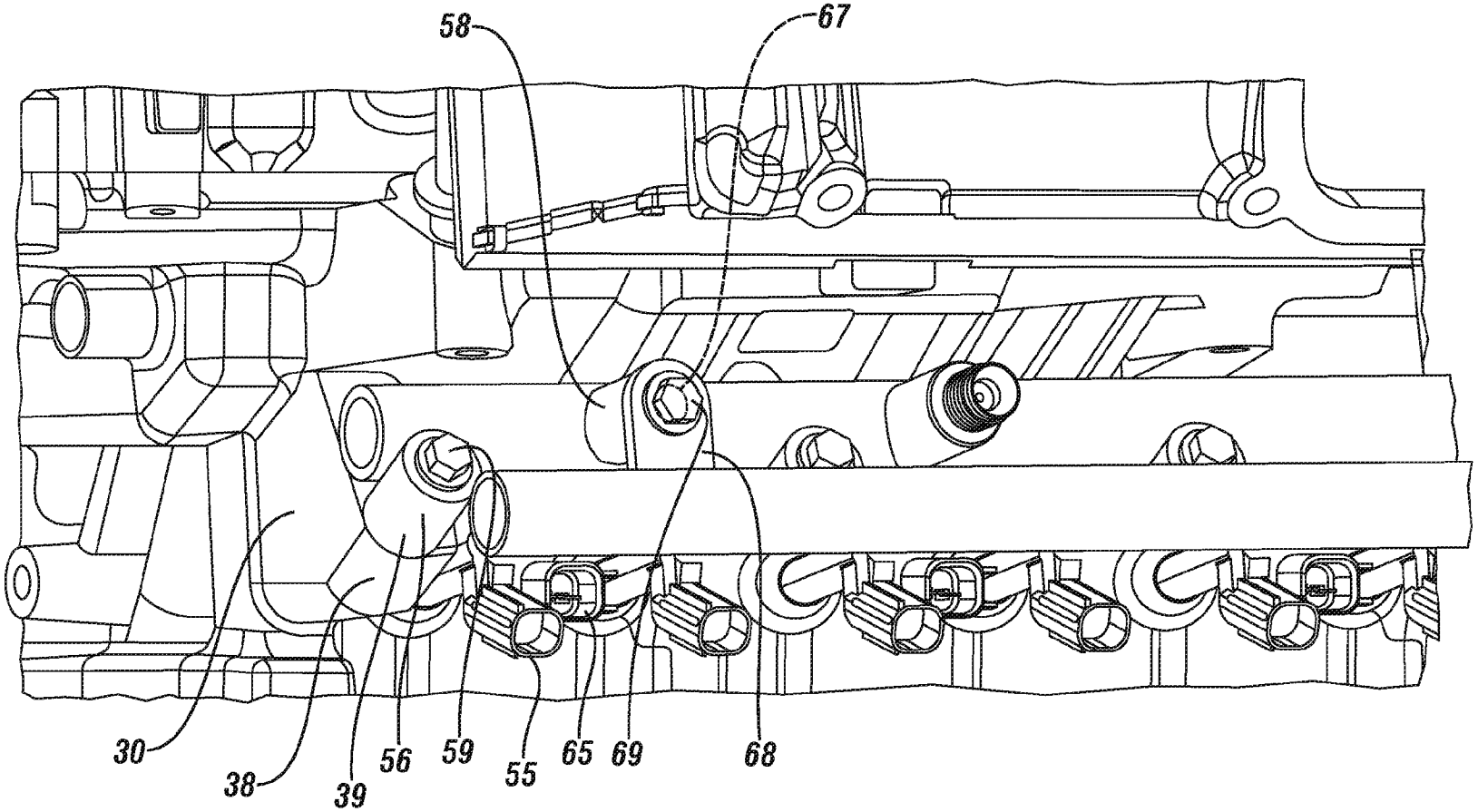
FIG. 3 schematically shows an isometric side view of an embodiment of the engine including the dual fuel rail assembly, in accordance with the disclosure.

Referring now to the drawings, wherein the showings are for the purpose of illustrating certain exemplary embodiments only and not for the purpose of limiting the same, FIG. 1 schematically shows a cutaway end view of a portion of an internal combustion engine (engine) 10 including details of a single cylinder 20 and associated dual fuel rail assembly 45 that is configured in accordance with an embodiment of this disclosure. FIG. 2 schematically shows an isometric view of an embodiment of the dual fuel rail assembly 45, and FIG. 3 schematically shows an isometric side view of an embodiment of the engine 10 including the dual fuel rail assembly 45. Like numerals refer to like elements in the various drawings.

The engine 10 includes an engine block 12 having a plurality of cylinders 20 formed therein and a cylinder head 30 assembled onto a top portion thereof. A moveable piston 18 is inserted into each cylinder 12, and connects through a connecting rod to a rotating crankshaft assembled onto a bottom portion of the engine 10. Each cylinder 20, piston 18 and portion of the cylinder head 30 forms a variable volume combustion chamber 16.

The cylinder head 30 is a cast or machined component that includes one or a plurality of intake ports 32 and intake throats 34 that include intake valve seats, one or a plurality of exhaust ports 33 and exhaust throats 35 that include exhaust valve seats, an injector tip opening 46, and a spark plug opening 47. One or more intake valves 36 is assembled into the cylinder head 30 at each of the intake throats 34 for each corresponding cylinder 20 in the engine block 12 to effect control of intake airflow through the intake port 32. One or more exhaust valves 37 is assembled into the cylinder head 30 at each of the exhaust throats 35 for each corresponding cylinder 20 in the engine block 12 to effect control of exhaust gas flow through the exhaust port 33. Activations of the intake valves 36 and exhaust valves 37 are controlled by a camshaft and/or another suitable valve activation mechanism, with such activation indexed to rotation of the crankshaft. The cylinder head 30 also includes a plurality of external mounting bosses 38 arranged along an exterior, or outer side thereof, with the mounting bosses 38 preferably including a flat surface and a threaded aperture 39.

The dual fuel rail assembly 45 includes a first fuel rail 50 and a second fuel rail 60, with the second fuel rail 60 having a longitudinal axis that is parallel to a longitudinal axis of the first fuel rail 50 when assembled onto the first fuel rail 50 as described herein. The first and second fuel rails 50, 60 are tubular manifold elements that distribute fuel from pressurized fuel supplies to individual first and second fuel injectors 52, 62, respectively, that are fluidly coupled thereto. The first and second fuel rails 50, 60 may include a fuel pressure regulator in some embodiments. The first and second fuel rails 50, 60 may have return lines leading to a fuel source in some embodiments.

The first fuel rail 50 fluidly connects to a plurality of first fuel injectors 52, with one of the first fuel injectors 52 associated with each of the cylinders 20. Each of the first fuel injectors 52 includes a fuel-delivering tip portion 54 that projects through an opening 46 in the cylinder head 30 into the combustion chamber 16 of the cylinder 20, which may be referred to as "direct injection". Each of the first fuel injectors 52 is a high pressure solenoid-actuated injector that meters high pressure fuel supplied from the first fuel rail 50 into the combustion chamber 16, and is controlled via an electrical signal that originates at an engine controller that is communicated to the first fuel injector 52 through a first wiring harness that electrically connects to a first electrical connector 55. Other injector design and interface features that are ancillary to this disclosure are not described. The first fuel rail 50 includes a plurality of inwardly projecting first mounting brackets 56 that align with and match up with the mounting bosses 38 included on the cylinder head 30. Each of the first mounting brackets 56 includes an aperture 57 through which a fastener 59 is inserted. The fastener 59 is a hex-head bolt or other suitable fastener having a threaded end that mates with the threaded aperture 39 of the corresponding mounting boss 38. The first mounting brackets 56 align with and cover the flat surface of the mounting boss 38 and are compressively mounted thereon by action of inserting the fasteners 59 into the threaded apertures 39 when the dual fuel rail assembly 45 is assembled onto the cylinder head 30. The first fuel rail 50 also includes a plurality of outwardly projecting threaded mounting bosses 58. The first fuel rail 50 is assembled onto and fixedly attaches to an outer portion of the cylinder head 30 employing the plurality of fasteners 59 that pass through the apertures 57 of the first mounting brackets 56 and attach to the corresponding mounting bosses 38 of the cylinder head 30. The terms 'inward', 'inwardly' and other related terms are employed describe portions or elements directed towards the inner portion of the engine 10, e.g., the cylinder 20 or the combustion chamber 16. The terms 'outward', 'outwardly' and other related terms are employed to describe portions or elements directed away from the inner portion of the engine 10.

The second fuel rail 60 fluidly connects to a plurality of second fuel injectors 62, with one of the second fuel injectors 62 associated with each of the cylinders 20. Each of the second fuel injectors 62 includes a fuel-delivering tip portion 64 that projects through an opening 40 in the cylinder head 30 into a bottom portion 42 of the associated intake port 32, which may be referred to as "port injection". The bottom portion 42 of the associated intake port 32 is that portion of the intake port 32 that is located towards an outer portion of the cylinder head 30 and the crankshaft, and away from the exhaust valve 37. Each of the second fuel injectors 62 is a pressure solenoid-actuated injector that meters high pressure fuel supplied from the second fuel rail 60 into the intake port 32, and is controlled via an electrical signal that originates at an engine controller that is communicated to the second fuel injector 62 through a second wiring harness that electrically connects to a second electrical connector 65. Again, other injector design and interface features that are ancillary to this disclosure are not described. The second fuel rail 60 includes a plurality of inwardly projecting second mounting brackets 68 each including an aperture 67 through which a fastener 69 passes. The second fuel rail 60 is assembled onto and fixedly attaches to the outwardly projecting, threaded mounting bosses 58 of the first fuel rail 50 by action of inserting the fasteners 69 through the apertures 67 of the second mounting brackets 68 into the corresponding threaded mounting bosses 58 of the first fuel rail 50. The quantity and design of fasteners 69, second mounting brackets 68 and corresponding threaded mounting bosses 58 of the first fuel rail 50 are selected to withstand reaction forces caused by activation of the second fuel injectors 62 and the high pressure fuel supplied from the second fuel rail 60 into the intake port 32. Preferably the first electrical connector 55 has a cross-sectional design that differs from the cross-sectional design of the second electrical connector 65. Such an arrangement including differing designs for the first and second electrical connectors 55, 65 prevents mis-assembly of the first and second wiring harnesses to the first and second electrical connectors 55, 65.

The dual fuel rail assembly 45 may be assembled onto the cylinder head 30 by assembling the first fuel rail 50 including the first injectors 52 onto the cylinder head 30, and then assembling the second fuel rail 60 including the second injectors 62 onto the first fuel rail 50. Alternatively, the dual fuel rail assembly 45 may be assembled onto the cylinder head 30 by assembling the second fuel rail 60 onto the first fuel rail 50 prior to assembly onto the cylinder head 30. Preferably the first and second electrical connectors 55, 65 are arranged on bodies of the first and second fuel injectors 52, 62, respectively, such that they align in a row that is parallel to the first fuel rail 50.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An internal combustion engine, comprising:

a cylinder bank of an engine block and an associated cylinder head forming a plurality of variable volume combustion chambers;

the cylinder head including a plurality of intake ports, intake throats, and intake valves associated with the combustion chambers, and a plurality of mounting bosses;

a first fuel rail fluidly connecting to a plurality of first fuel injectors associated with the cylinders and a second fuel rail fluidly connecting to a plurality of second fuel injectors associated with the cylinders;

each of the first fuel injectors including a fuel-delivering tip portion projecting through an opening in the cylinder head into the corresponding combustion chamber of the associated cylinder;

each of the second fuel injectors including a fuel-delivering tip portion projecting through an opening in a bottom portion of the intake port of the cylinder head of the associated cylinder;

the first fuel rail including a plurality of first mounting brackets each including an aperture and a plurality of mounting bosses;

the first fuel rail fixedly attaching to the cylinder head via a plurality of fasteners that pass through the apertures of the first mounting brackets and attach to the mounting bosses of the cylinder head;

the second fuel rail including a plurality of second mounting brackets each including an aperture; and the second fuel rail fixedly attaching to the first fuel rail via a plurality of fasteners that pass through the apertures of the second mounting brackets and attach to the mounting bosses of the first fuel rail.

2. The internal combustion engine of claim 1, wherein the plurality of mounting bosses comprises a plurality of threaded mounting bosses located on an outer portion of the cylinder head.

3. The internal combustion engine of claim 1, wherein the first fuel rail including a plurality of first mounting brackets each including an aperture and a plurality of mounting bosses comprises the first fuel rail includes a plurality of inwardly projecting first mounting brackets each including an aperture and a plurality of outwardly projecting threaded mounting bosses.

4. The internal combustion engine of claim 1, wherein the second fuel rail fixedly attaching to the first fuel rail via a plurality of fasteners comprises the second fuel rail assembled onto the first fuel rail via the plurality of fasteners that pass through the apertures of the second mounting brackets and attaching to a plurality of outwardly projecting threaded mounting bosses attached to the first fuel rail.

5. A dual fuel rail assembly for a multi-cylinder internal combustion engine, comprising:

a first fuel rail fluidly connecting to a plurality of first fuel injectors associated with the cylinders and a second fuel rail fluidly connecting to a plurality of second fuel injectors associated with the cylinders;

each of the first fuel injectors including a fuel-delivering tip portion configured to project through an opening in a cylinder head of the engine into a corresponding combustion chamber of the associated cylinder;

each of the second fuel injectors including a fuel-delivering tip portion configured to project through an opening in a bottom portion of an intake port of the cylinder head for the associated cylinder;

the first fuel rail including a plurality of first mounting brackets each including an aperture and a plurality of mounting bosses;

the first fuel rail fixedly attachable to the cylinder head via a plurality of fasteners that pass through the apertures of the first mounting brackets and corresponding to mounting bosses on the cylinder head;

the second fuel rail including a plurality of second mounting brackets each including an aperture; and the second fuel rail fixedly attaching to the first fuel rail via a plurality of fasteners that pass through the apertures of the second mounting brackets and attach to the mounting bosses of the first fuel rail.

6. The dual fuel rail assembly of claim 5, wherein the first fuel rail including a plurality of first mounting brackets each including an aperture and a plurality of mounting bosses comprises the first fuel rail includes a plurality of inwardly projecting first mounting brackets each including an aperture and a plurality of outwardly projecting threaded mounting bosses.

7. The dual fuel rail assembly of claim 5, wherein the second fuel rail fixedly attaching to the first fuel rail via a plurality of fasteners comprises the second fuel rail assembled onto the first fuel rail via the plurality of fasteners that pass through the apertures of the second mounting brackets and attaching to a plurality of outwardly projecting threaded mounting bosses attached to the first fuel rail.

8. A method for attaching a dual fuel rail assembly to a multi-cylinder internal combustion engine, the method comprising:

assembling a first fuel rail including a plurality of first fuel injectors onto the internal combustion engine, including inserting a plurality of fuel-delivering tip portions of the first fuel injectors through openings in a cylinder head of the engine into combustion chambers of associated cylinders thereof, and fixedly attaching the first fuel rail to mounting bosses on the cylinder head; and assembling a second fuel rail including a plurality of second fuel injectors onto the internal combustion engine, including inserting a plurality of fuel-delivering tip portions of the second fuel injector through an opening in a bottom portion of the intake port of the associated cylinder formed in the cylinder head and fixedly attaching the second fuel rail to mounting bosses on the first fuel rail.

* * * * *